US006012531A

United States Patent [19]

Ryan

[11] Patent Number: 6,012,531

[45] Date of Patent: Jan. 11, 2000

[54] FIRE EXTINGUISHING BOMB

[76] Inventor: James W. Ryan, 723 Chanese La., Absecon, N.J. 08201

[21] Appl. No.: 09/062,922

[22] Filed: Apr. 20, 1998

[51] Int. Cl.[7] ..... A62C 8/00

[52] U.S. Cl. ..... 169/36; 169/28; 169/DIG. 3; 102/487; 239/70; 239/309

[58] Field of Search ..... 169/26, 28, 35, 169/36, 47, 54, 58, 70, DIG. 3; 239/70, 309; 102/276, 487

[56] References Cited

U.S. PATENT DOCUMENTS

| | | | |
|---|---|---|---|
| D. 342,809 | 12/1993 | Thomas | D29/2 |
| 1,565,036 | 12/1925 | Tank | 169/36 |
| 3,492,944 | 2/1970 | Reaves et al. | 169/28 X |
| 3,980,139 | 9/1976 | Kirk | 169/28 |
| 4,285,403 | 8/1981 | Poland | 169/28 |
| 4,760,886 | 8/1988 | Sassier | 169/28 |
| 4,878,415 | 11/1989 | Foster, Jr. et al. | 89/34 |
| 4,964,469 | 10/1990 | Smith | 169/36 X |
| 5,183,117 | 2/1993 | Strickland | 169/28 X |
| 5,390,580 | 2/1995 | Gibbons, Jr. et al. | 86/50 |
| 5,582,254 | 12/1996 | Pistek | 169/36 X |

*Primary Examiner*—Andres Kashnikow
*Assistant Examiner*—Steven J. Ganey
*Attorney, Agent, or Firm*—Goldstein & Canino

[57] ABSTRACT

A fire extinguishing device to reduce or extinguish a fire in a specific localized area such as a room or a hallway within a burning building. A base with a disbursement container fixed to the base is provided to hold an explosive charge and a volume of fire extinguishing agent. When the explosive charge is detonated, the extinguishing agent is forced out of the disbursement container in an upward direction to subsequently shower down upon a fire in the vicinity of the detonated fire extinguishing device to at least in part extinguish the fire in the localized area.

12 Claims, 3 Drawing Sheets

FIG.2
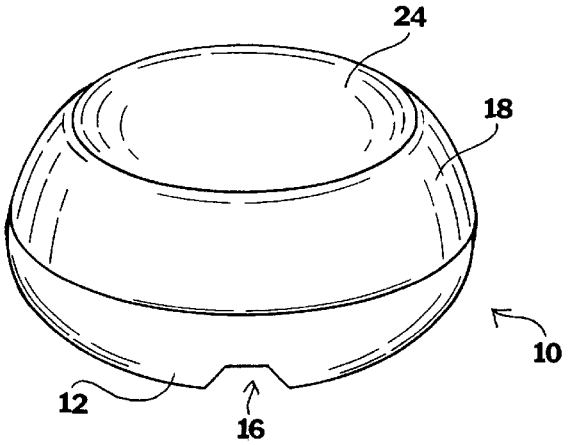
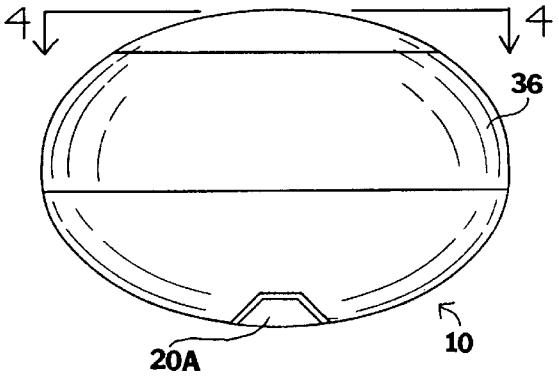
FIG.3
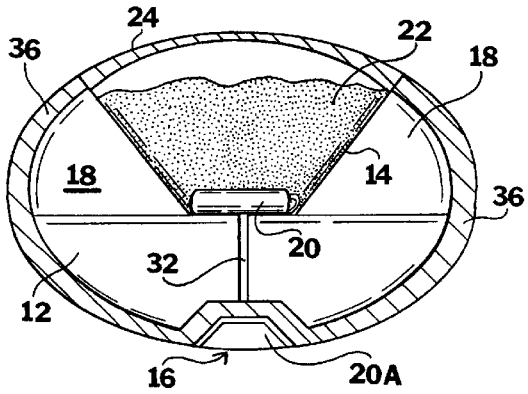
FIG.4
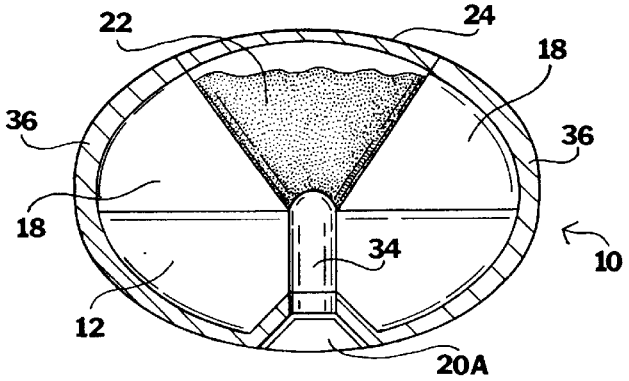
FIG.5

FIRE EXTINGUISHING BOMB

BACKGROUND OF THE INVENTION

1 . Field of the Invention

The invention relates to fire extinguishing devices. More particularly, the present invention relates to a device that directionally disburses an extinguishing agent through the use of an explosive charge.

2 . Background and Objects of the Invention

When a fire occurs, fire fighting individuals often find it necessary to enter or re-enter a building to search for persons that may still be within the building. It is a common occurrence for these individuals to be burned, possibly severely, or even to be killed, when such an attempt is made. Often, the fire fighting person or other individuals may need to enter a room or pass through a hallway (consumed with flames) when attempting to locate trapped individuals, or while attempting egress from a burning building. In such instances, it would be highly desirable to employ a device that may be set off (or detonated) to knock down or extinguish flames of the fire, even if for only a short period of time and even in a localized area.

A number of prior art devices are available in the art to provide temporary relief in the vicinity in which they are utilized. For example U.S. Pat. No. 3,980,139 to Kirk is one such device. The Kirk device provides a bomb that can be detonated within a fire. This device employs an 'automatic heat triggered' detonation means, and therefore, requires a possibly random period of time before detonation may occur. Further, due to extreme heat, the device may false trigger at an inappropriate time. The Kirk device also includes a glass cylinder (to hold a volume of extinguishing agent) "that can be readily fragmented so as to disperse its chemical content in all directions". The use of this dispersal arrangement may prove to be hazardous to nearby persons when the device is detonated. A device with a safer and more directional disbursement would be useful.

U.S. Pat. No. 4,285,403 to Poland provides an explosive fire extinguisher that is designed to be dropped from an aircraft into fires such as forest fires. The device may be shock triggered on impact. Accordingly, this device and other bomb-like extinguishing devices, while suitable for the particular purposes intended, or for more general use, would not be suitable for the purposes contemplated for the present invention, as will be fully discussed below.

Objects of the present invention are, therefore, to provide new and improved detonatable fire extinguishing or fire reducing devices having one or more of the following capabilities, features, characteristics, and/or advantages:

self contained compact and simple design;

includes an internal cavity to hold and secure a volume of fire extinguishing agent;

reusable embodiments that may be reloaded, typically at a later time, and used over and over;

structured to directionally disburse the volume of the extinguishing agent in an upward somewhat substantially vertical direction wherein at least a portion thereof 'showers down'upon the fire in the vicinity of the detonated fire extinguishing device;

the internal cavity frangibly capped to secure the extinguishing agent within the cavity until detonation occurs;

having a timer to enable a user to situate the device and move a safe distance away before detonation occurs;

may be embodied with a standard explosive charge, such as an M40 type explosive; and very simple and economical construction;

The above listed objects, advantages, and associated novel features of the present invention, as well as others, will become more clear with a careful review of the description and FIGS. provided herein. Attention is called to the fact, however, that the drawings and the associated description are illustrative only, and variations are certainly possible.

SUMMARY OF THE INVENTION

In accordance with the present invention, a fire extinguishing device is disclosed employing an explosive charge to disburse a volume of a fire extinguishing agent. The fire extinguishing device is comprised of a base with a disbursement container fixed to the base. The disbursement container has an open upper end and a closed bottom end, and provides a cavity for holding a volume of the fire extinguishing agent. The upper open end is oriented in a substantially vertical position to discharge the extinguishing agent in a upward direction. An explosive charge possibly located within the cavity of the disbursement container near the bottom end is substantially covered by the fire extinguishing agent. When the explosive charge is detonated by one of a number of suitable detonation means, the associated explosive discharge forces the extinguishing agent out of the disbursement container in an upward direction to subsequently (at least partially) shower down upon the flames of a fire in the vicinity of the fire extinguishing device to, at least in part, extinguish the fire in a localized area near the site of the detonation (i.e., in the general vicinity of the fire extinguishing device).

The present invention is contemplated to be configured as a reusable device that may be later reloaded with a new explosive charge and another volume extinguishing agent. Embodiments may include simple fusing means incorporating a timing device to enable a user to move a safe distance away from the device before detonation occurs.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of many possible arrangements utilizing the fundamental concepts of the present invention. The drawings are briefly described as follows:

FIG. 2 depicts an elevated perspective view of an embodiment of the invention assembled and ready for use.

FIG. 3 illustrates a front view of an embodiment of the present invention.

FIG. 4 provides a cross sectional view of the embodiment of

FIG. 3 taken along the line 4—4 of FIG. 3.

FIG. 5 shows yet another embodiment of the invention.

LIST OF REFERENCE NUMERALS USED IN THE DRAWINGS

10 —fire extinguishing device

12 —base

14 —disbursement container

Figure 1:
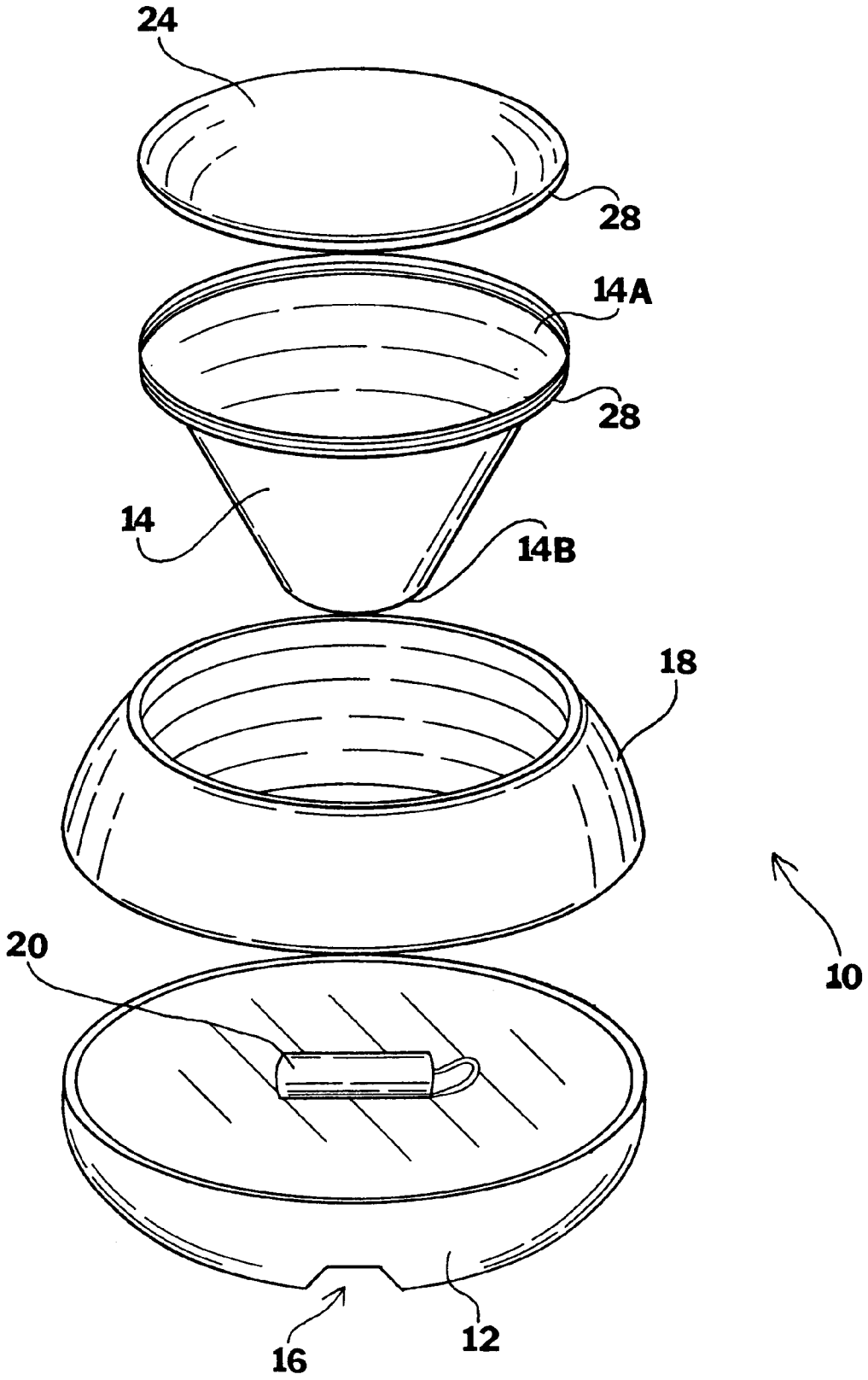
FIG. 1 provides an exploded view of an embodiment of the fire extinguishing device in accordance with the present invention.

14*a* —(upper) open end of disbursement container

14*b* —(closed) bottom end of disbursement container

16 —compartment

18 —annular dampener

20 —explosive charge

20*a* —detonator

22 —extinguishing agent

24 —cap

28 —threads

32 —bore

34 —(replaceable) shell

36 —outer cover

DETAILED DESCRIPTION OF THE PREFERRED EMBODIMENTS

It is important to establish the definition of several terms and expressions that will be used throughout this disclosure. The expressions 'fire extinguishing agent'and 'extinguishing agent'are to be defined as including any known substance in liquid, gaseous, or particulate form that may be employed to dampen or 'knock down' a fire, at least in part, and at least for a short period of time. The present invention is intended to provide relief by reducing or eliminating flames associated with a fire in the general or immediate vicinity where the invention is deployed. As such, the term 'vicinity' may be assumed to indicate generally near and around the fire reducing or extinguishing device. However, as the device is contemplated to be scalable and provided in a variety of sizes and configurations, the region or area affected by the detonation of the device may vary with the particular embodiment. Accordingly, a small and highly portable embodiment may only affect the flames of a fire in a relatively small area, say within a diameter of 10 to 15 feet. Alternately, when considering a larger embodiment, the term 'vicinity' may involve a significantly larger area, say within a diameter of 20 to 30 feet. The terms 'explosive charge' and simply 'charge' are to be defined as any means that may be set-off or detonated to expand rapidly, wherein the rapid expansion will result in the disbursement of the extinguishing agent (as will be further addressed below). Finally, the terms 'device', 'fire reducing device' and 'fire extinguishing device', are to be considered synonymous and interchangeable. Additional terms and expressions will be defined below as needed.

Figure 6:
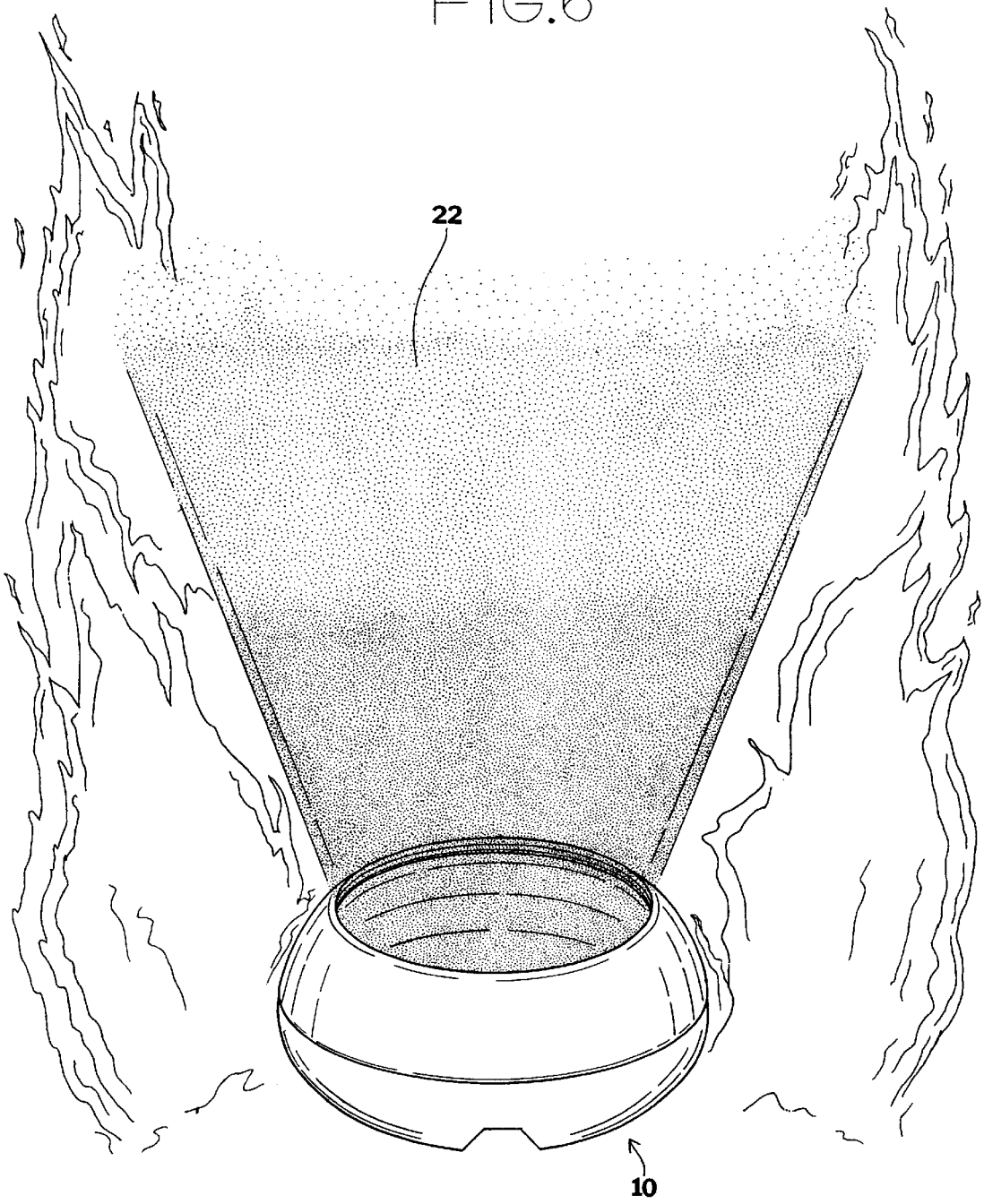
FIG. 6 depicts the detonation of the fire extinguishing device to disburse a volume of extinguishing agent.

Referring now to FIG. 1, there is illustrated an exploded view (having nothing to due with a detonation) of an embodiment of the fire extinguishing device 10 in accordance with the present invention. A base 12 provides a foundation to support a disbursement container 14 that is configured to hold a volume of the fire extinguishing agent 22, as clearly shown in FIGS. 4 and 5. As can be seen in FIGS. 1 and 4 an explosive charge 20 may be situated proximal to the base 12 near the bottom end 14*b* of the disbursement container 14. When detonated, the explosive charge 20 will cause the disbursement of the extinguishing agent 22, as illustrated in FIG. 6, and result in the reduction, at least in part, of flames associated with a fire in the vicinity of the fire extinguishing device 10.

In preferred embodiments of the present invention, a detonator 20*a,* which may be termed a detonation means, would be located in a recessed compartment 16 (as can be seen in FIGS. 2 through 5). The detonator 20*a* would be employed to enable a user to locate the fire extinguishing device 10 in a desired location, and move a safe distance away from the device before the explosive charge 20 is actually detonated. As will be appreciated by skilled persons, a variety of available charges 20 and detonators 20*a* are available in the art that would be suitable for the purposes of the present invention. For example, if the explosive charge 20 is provided by, say an M40 or M60 type of charge, the detonator 20*a* may be provided by well known igniters, which may further include a timer element or timing device to enable a user to move a safe distance away from the fire extinguishing device 10 before the device 10 is detonated. To couple the detonator 20*a* to the explosive charge 20, a bore 32 may be provided in the base 12. The bore 32, as can be seen in FIG. 4, may enable a wire, fuse, or other coupling means to operatively couple the detonator 20*a* and the explosive charge 20.

As shown in FIG. 4, the disbursement container 14 may be provided with a conical shape having an upper open end 14*a* and a possibly closed bottom end 14*b* . However, as the bottom end 14*b* is rigidly fixed to the base 12, a bottom wall of the disbursement container 14 may actually be provided by the base 12. In a preferred embodiment the combination of the base 12 and disbursement container 14 may be formed of a monolithic piece of metal such as steel. It should be understood that the disbursement container 14 may alternately be provided by a simple tube like arrangement, possibly with a flared upper end (not shown). Regardless of the particular shape employed to realize the disbursement container 14, the desired function, as clearly shown in FIG. 6, is to disburse the extinguishing agent 22 in an upward direction so as to enable the extinguishing agent 22 to, to some extent, contact flames and burning materials above the fire extinguishing device 10, and or to shower down upon burning materials in the vicinity of the device.

Referring again to FIG. 1, an annular dampener 18 may be provided that is wrapped circumferentially and tightly about the disbursement container 14 to dampen and assist in absorbing forces resulting from the detonation of the explosive charge 20. In a possibly preferred embodiment of the invention the annular dampener 18 may also serve as thermal insulation for the contents of the cavity of the disbursement container 14. In addition, as clearly seen in FIGS. 2 through 5, the annular dampener 18 may also assist in providing an overall 'rounded'shape to the fire extinguishing device 10. The rounded shape may be desired to enable the device 10 to be 'rolled'into a space consumed with flames. If properly constructed (with a suitably weighted base 12), the device may self right itself to establish the desired upright orientation shown in FIGS. 1 through 6. In addition, if embodied with the timed detonator 20*a,* the device may be rolled into such an area, and subsequently automatically detonated to reduce and or knock down the flames of a fire in the immediate vicinity. A frangibly fixed cap 24 is provided to cover and cap the upper open end 14*a* of the disbursement container 14 to secure the extinguishing agent 22 in the cavity until the fire extinguishing device 10 is detonated. The cap 24, or an equivalent structure may be configured to enhance the overall rounded shape of the fire extinguishing device 10 of the present invention, and when combined with a 'weighted', base 12, will result in the device 10 always being positioned in the desired 'upright'position when the device 10 comes to rest (before being detonated). The cap 24 may be frangibly mounted using yieldably mated threads 28 that are located upon the upper end 14*a* of the disbursement container 14 and the outer circumference of the cap 24, respectively (as shown in FIG. 1).

Turning to FIG. 5, there is illustrated therein an alternate embodiment of the invention. A (replaceable) shell 34 is included to provide the function of the explosive charge 20. The shell 34, which may be arranged to be quickly and easily replaced, may be employed with a mechanical detonation means, for example, that includes a 'firing pin'based arrangement.

An inherent characteristic of the present invention, especially when considering the configuration of FIGS. 3 and 4, is the location of the explosive charge 20. As skilled persons will appreciate, if the materials selected to embody the device 10 have suitable thermal isolating characteristics, the possibility of the explosive charge 20 being accidentally detonated due to high ambient temperature is reduced. Accordingly, as shown in FIG. 4 an outer cover 36 may be provided which is a known thermal insulator. For example, an outer cover 36 of stainless steel may be provided for such a purpose.

It is important to understand that the above description of the embodiments of the fire extinguishing device 10 of the present invention are exemplary only, and other equivalent arrangements are certainly possible. Therefore, while there have been described the currently preferred embodiments of the present invention, those skilled in the art will recognize that other and further modifications may be made without departing from the present invention, and it is intended to claim all modifications and variations as fall within the scope of the appended claims.

What is claimed is:

1. A fire extinguishing device employing an explosive charge to disburse a volume of a fire extinguishing agent, the fire extinguishing device comprising:

a) a base;

b) a disbursement container having a upper open end and a possibly closed bottom end, and providing a cavity for holding a volume of the fire extinguishing agent; the disbursement container fixed to the base at the bottom end and positioned with the open end axially oriented in a substantially vertical position;

c) an explosive charge located within the cavity of the disbursement container proximal to the bottom end and substantially covered by the fire extinguishing agent; and d) detonation means suitably coupled to detonate the explosive charge to disburse the fire extinguishing agent in an upward direction;

e) the disbursed fire extinguishing agent provided to extinguish, at least in part, flames of a fire in the vicinity of the fire extinguishing device.

2. The fire extinguishing device according to claim 1, wherein the base includes a recessed compartment to house the detonation means and a bore to enable the detonation means to be coupled to the explosive charge.

3. The fire extinguishing device according to claim 2, wherein the detonation means further includes a timing device to enable a user to move a safe distance away from the fire extinguishing device before detonation occurs.

4. The fire extinguishing device according to claim 3, further including a cap that is frangibly fixed to the upper open end of the disbursement container to secure the extinguishing agent in the cavity until the fire extinguishing device is detonated.

5. The fire extinguishing device according to claim 1, wherein the disbursement container is conically shaped with the open end having a larger diameter that the bottom end.

6. The fire extinguishing device according to claim 5, further comprising an annular dampener circumferentially and tightly wrapped about the disbursement container to dampen and assist in absorbing forces resulting from the detonation of the explosive charge.

7. A detonatable fire reducing device having a substantially rounded shape that is employed to extinguish, at least in part, flames of a fire in the immediate vicinity of the device, comprising:

a) a weighted base arranged to maintain the fire reducing device in a selected location with a desired upright orientation until detonated;

b) a volume of a fire extinguishing agent;

b) a disbursement container fixed to the base with an upper open end, and providing a cavity for holding the volume of fire extinguishing agent, the disbursement container axially oriented in a substantially vertical position;

c) an explosive charge suitably coupled to the cavity of the disbursement container so as to forcibly expel and disburse the extinguishing agent in an upward and somewhat outward direction when the charge is detonated; and d) detonation means suitably coupled to the charge to cause detonation of the charge and the disbursement of the extinguishing agent to extinguish, at least in part, flames of a fire in the vicinity of the fire reducing device;

e) the fire reducing device having the substantially rounded shape to enable the device to be rolled into an area of the fire so that the device may self right itself to establish the desired upright orientation before detonation occurs.

8. The detonatable fire reducing device according to claim 7, wherein the base includes a recessed compartment to house and possibly shield the detonation means.

9. The detonatable fire reducing device according to claim 8, wherein the explosive charge is configured as a replaceable shell and a bore is provide in the base to couple the explosive charge to the cavity of the disbursement container to enable the extinguishing agent to be forcible discharged from the cavity when the charge is detonated.

10. The detonatable fire reducing device according to claim 9, wherein the detonation means includes a timing device to enable a user to move a safe distance from the device before detonation occurs.

11. The detonatable fire reducing device according to claim 10, further including a cap frangibly fixed to the open end of the disbursement container to secure the extinguishing agent in the cavity until detonated.

12. The detonatable fire reducing device according to claim 10, further including an outer cover to thermally insulate the interior cavity and charge of the device until detonated.

* * * * *